US010240858B2

(12) United States Patent
Ertik et al.

(10) Patent No.: US 10,240,858 B2
(45) Date of Patent: Mar. 26, 2019

(54) HOME APPLIANCE HAVING DRAWER-TYPE MOVABLE CONTAINER WITH A HANDLE

(71) Applicant: BSH HAUSGERATE GMBH, Munich (DE)

(72) Inventors: Mustafa Ertik, Tekirdag (TR); Tanzer Yildizgoecer, Tekirdag (TR)

(73) Assignee: BSH Hausgeraete GmbH, Munich (DE)

( * ) Notice: Subject to any disclaimer, the term of this patent is extended or adjusted under 35 U.S.C. 154(b) by 0 days.

(21) Appl. No.: 15/539,285

(22) PCT Filed: Dec. 2, 2015

(86) PCT No.: PCT/EP2015/078363

§ 371 (c)(1),
(2) Date: Jun. 23, 2017

(87) PCT Pub. No.: WO2016/102162

PCT Pub. Date: Jun. 30, 2016

(65) Prior Publication Data

US 2018/0180351 A1 Jun. 28, 2018

(30) Foreign Application Priority Data

Dec. 25, 2014 (TR) ..... u 2014 15828

(51) Int. Cl.
*F25D 25/02* (2006.01)
*A47B 95/02* (2006.01)

(52) U.S. Cl.
CPC ..... *F25D 25/025* (2013.01); *A47B 2095/024* (2013.01); *F25D 2400/18* (2013.01)

(58) Field of Classification Search
CPC ..... A47B 95/02; A47B 2095/024; A47B 2210/17; A47B 2210/175; F25D 25/025; F25D 2325/00; F25D 2400/18; F25D 23/02; F25D 23/04; F25D 23/028
See application file for complete search history.

(56) References Cited

U.S. PATENT DOCUMENTS

| | | | | |
|---|---|---|---|---|
| 4,096,603 A | 6/1978 | Klaus | | |
| 4,862,553 A * | 9/1989 | Festoso | A47B 95/02 | 16/416 |
| 4,926,523 A * | 5/1990 | Carlson | F25D 23/028 | 16/412 |
| 5,221,135 A * | 6/1993 | Nakamura | A47B 95/02 | 16/110.1 |
| 2003/0020384 A1 * | 1/2003 | Bush | F25D 25/021 | 312/348.4 |

(Continued)

FOREIGN PATENT DOCUMENTS

| | | | |
|---|---|---|---|
| CH | 635992 A5 | 5/1983 | |
| CN | 202432812 U * | 9/2012 | F25D 25/02 |

(Continued)

*Primary Examiner* — Andrew M Roersma
(74) *Attorney, Agent, or Firm* — Laurence A. Greenberg; Werner H. Stemer; Ralph E. Locher

(57) ABSTRACT

A home appliance, particularly a domestic refrigerator, includes a container being a drawer-type movable container and having a handle for the container. The handle has a connection profile fixed to the container and a second profile fixed to the connection profile, for forming the handle.

17 Claims, 8 Drawing Sheets

(56) References Cited

U.S. PATENT DOCUMENTS

| | | | | | |
|---|---|---|---|---|---|
| 2009/0071966 | A1* | 3/2009 | Benz | ..... | F25D 25/005<br>220/592.01 |

FOREIGN PATENT DOCUMENTS

| | | | | | |
|---|---|---|---|---|---|
| DE | 4239961 | A1 * | 6/1994 | ..... | A47B 95/02 |
| DE | 4304484 | A1 * | 8/1994 | ..... | F25D 25/025 |
| DE | 20102359 | U1 | 4/2001 | | |
| DE | 202005012342 | U1 * | 10/2005 | ..... | F25D 25/025 |
| EP | 2023063 | A2 * | 2/2009 | ..... | F25D 23/02 |
| GB | 2131290 | A | 6/1984 | | |
| JP | 2004218864 | A * | 8/2004 | | |
| WO | 2009080483 | A1 | 7/2009 | | |
| WO | WO-2011131438 | A2 * | 10/2011 | ..... | F25D 23/02 |
| WO | 2013094872 | A1 | 6/2013 | | |

* cited by examiner

Detail-A

Detail-B

HOME APPLIANCE HAVING DRAWER-TYPE MOVABLE CONTAINER WITH A HANDLE

FIELD OF INVENTION

The invention is related to a home appliance, for example a domestic cooling device, having a drawer-type movable container and having a handle for the container.

PRIOR ART

Most of the home appliances, particularly domestic cooling device like a refrigerator, have a chamber and a container in the chamber to position an item (food, drink etc.) to be stored in the home appliance.

The container may be stationary or movable. The movable container is generally a drawer like a crisper for a domestic refrigerator. Such containers need a handle to be gripped and pulled out of the chamber or pushed into the chamber.

The handle of the container may be obtained as a single piece element together with the container. However, due to productivity problems for some handle designs, the handle may be obtained separate from the container and later fixed to the container.

Meanwhile, the home appliances have different brands and different designs for each brand, even for different variants of the same brand. That brings high complexity and production cost for the manufacturer.

The containers may have a brand or a variant specific design, just having different handles for the same container. As an example for such handles, the document numbered as WO2009080483 A1 may be presented. The document discloses a refrigerating device having a drawer-type container a handle strip arranged on the container. The handle strip is fixed to the container with a positive connection to ensure that unintentional loosening of the handle strip is avoided. This document discloses a one part handle strip to be fixed on the container. The brand-specific design can be expressed both by the shape, as well as color and lettering.

The invention provides an additional improvement, an additional advantage or an alternative to the prior art.

BRIEF SUMMARY OF THE INVENTION

The purpose of the invention is providing a home appliance having a container with a handle increasing possibility for brand or variant specific design.

The invention, to achieve the abovementioned purpose, is a home appliance, particularly a domestic cooling device, comprising a container being a drawer-type movable container and having a handle for the container, and that the handle has a connection profile fixed to the container and a second profile fixed to the connection profile, for forming the handle. Thus, as well as shape, color, and lettering, the handle may also be designed by using different materials and their combinations. Moreover, by using a cheaper material for the connection profile compared to the material of the second profile, a cheaper handle having same or similar appearance may be obtained compared to a single piece handle made of the expensive material.

The home appliance may be a cooling device like a freezer, a refrigerator or a fridge-freezer combination; or any home appliance known as having a drawer-type container with a handle.

The home appliance, particularly the cooling device, may have a chamber to accommodate the container therein. The walls of the chamber may be made of plastic, composite material, metal (stainless steel, aluminum etc.), painted metal (painted aluminum etc.) or any other material known in the art as a material used to form the chamber of a home appliance.

The chamber of the home appliance may be closed with a door attached to the chamber. The door may be attached to the chamber as rotatable around a pivot or as slidable toward or away from the chamber. For instance, the door may be hinged to the chamber. In another embodiment, the door may be attached to the chamber by a rail as slidable. The rail may be a telescopic rail or any rail system known as used on a home appliance for such a door.

The container may have a bottom and four side walls with an opening on top for accessing inside of the container. The handle may be located on the side wall facing the user, usually named front wall. The front wall of the container having the handle thereon may be formed as providing a recess together with the handle for at least one hand of the user. The recess may extend along the entire width of the container.

The home appliance also may have one or more shelves for any other items to be stored. The shelf may be any platform allowing locating an item thereon. In an embodiment, the shelf may be a plate made of glass, polymer, composite material or any material known as used to obtain such a shelf. Moreover, the door may have a door bin on its inner wall facing inside of the chamber.

The item disposed in the cooling device may be food or a container containing food like a bottle or a jar or a package.

The connection profile may be obtained by any method known as shaping method of plastics or metals such as injection molding, extrusion, lathe etc.

The second profile may be a functional profile or a decorative profile or both. It may be obtained by any method known as shaping method of plastics or metals such as injection molding, extrusion, lathe etc.

In a possible embodiment of the invention, the connection profile may be connected to the container by at least one of force-fit and form-fit. So that, no additional fixing element may be needed. Therefore, the material and labor cost and as a result production cost may be decreased. Not having additional fixing element may make the handle have a smooth design and look due to not having any visual hole or fixing element. On the other hand, smooth design may make the cleaning of the handle facilitated.

Force-fit may be a clamp or a grabbing as fixing by the help of frictional force. Form-fit may be a snap-fit or slidable connection using the compatibility of forms of the corresponding sections of the connection profile and the container. In a possible embodiment of the invention, the connection profile may have a connection housing for a connection edge of the container. Cross sectional form of the connection edge and the housing may be as corresponding to each other. At least one of the walls of the housing may be flexible, so that it may allow connection and disconnection only if a suitable amount of force is applied. That force may be greater than the force needed to pull a fully loaded container. In an additional possible embodiment of the invention, the connection profile may have a tab for connecting to the container. Thus a stable and durable connection may be obtained. The connection profile may have one or more than one tab. Multiple tabs may be spaced along the connection profile. On the possible embodiment having tab, there may not be a flexible wall, since the tab may be flexible and may hold the connection edge in the housing by a free end, for example in hook shape. During the mounting the tab may be flexed due to the connection edge and it may come back to its resting position and lock the connection edge in the housing when the connection edge is entirely put in the housing. The handle may be separated from the container by applying maybe the same force as applied during mounting. This also makes the handle changeable in case of a damage or need of service; or releasable for cleaning.

In a possible embodiment of the invention, the connection profile and the second profile may be connected to each other by at least one of force-fit, form-fit, adhesive and fixing element. Thus, by the help of force-fit or form-fit, the need of an additional fixing element may be eliminated. This also may decrease material and labor cost and as a result production cost. Despite of that, adhesives or additional fixing element may also be used to connect the connection profile and the second profile individually or supplementary connection for force-fit and/or form-fit. As a result, a strong, durable and stable handle may be obtained on the container.

Force-fit may be a clamp or a grabbing as fixing by the help of frictional force. Form-fit may be a snap-fit or slidable connection using the compatibility of forms of the corresponding sections of the connection profile and the second profile.

In a possible embodiment of the invention, one of the second profile and the connection profile may have a housing for an extension of the other one of the second profile and the connection profile. Thus a force-fit or a form-fit connection may be achieved. As a result, the material and labor cost and as a result production cost may be decreased; since an additional fixing element is not used. In a possible embodiment, the extension may be in form of a plate. Thus a force-fit connection may be obtained. Since the production of a plate and a housing for a plate is simpler compared to most of the shapes, the production may be facilitated. For instance, the connection profile and the second profile may be obtained by extrusion (plastic or metal extrusion).

In a possible embodiment of the invention, the connection profile may have an adhesion wall for the second profile. Thus, fixation of the second profile is ensured. Additionally, if the second profile is in form a plate or similar, adhesion of the plate on the adhesion wall may ensure that the plate will not be deflected on the connection profile.

In a possible embodiment of the invention, the second profile may have a connection wall covering a side wall of the connection profile. Thus the side wall of the connection profile may be concealed. As a result, the access of user to the connection profile may be prevented. Additionally, if the connection profile and the second profile are made of different materials (e.g. plastic and metal), the connection profile may be concealed visually from the user's sight and may give the impression of that the handle is made of only the material of the second profile (e.g. metal). In this case, the second profile may be employed as a decorative profile.

In a possible embodiment of the invention, the connection wall of the second profile may have a hole for a fixing element. Thus a fixing element such as a screw or a rivet may be used to fix the second profile on the connection profile.

In a possible embodiment of the invention, the second profile may have a gripping wall. In another possible embodiment of the invention, the connection profile may have a gripping wall. It is also possible to have gripping wall on both the connection profile and the second profile. Thus, usage of the handle may be realized and may be facilitated by having a gripping wall. The gripping wall may be ergonomic for usage with a human hand. The gripping wall may be formed such that a gripping housing is provided on the handle for at least one hand of the user.

In a possible embodiment of the invention, the second profile or the connection profile has a stiffening rib for supporting the gripping wall. Thus the gripping wall may be supported against possible physical deformations. The stiffening ribs may support the gripping wall by extending between an upper wall of the handle and the gripping wall. Thus they also support the upper wall against possible physical deformations. Moreover, using the stiffening ribs may decrease amount of used material to obtain the second profile or the connection profile compared to having a complete wall for supporting the gripping wall.

The handle may have one or more than one stiffening ribs. The stiffening ribs may be spaced along the handle.

In a possible embodiment of the invention, the handle may have a cover plate as an upper wall of the handle. Thus, if the second profile and/or the connection profile are made of a material that makes hard or impossible to form a single piece second profile and/or a single piece connection profile with an upper wall, the upper wall of the handle may be obtained. On the other hand, if the second profile and/or the connection profile are designed such that it makes hard or impossible to form a single piece second profile and/or a single piece connection profile with an upper wall, the upper wall of the handle may be obtained. In a possible embodiment, the cover plate may be at least one of metal, plastic and composite. Thus, different designs and combinations may be obtained for a brand or variant specific handle. Moreover, using a hard material for the cover plate may make the handle more durable to use on a fully loaded container.

In a possible embodiment of the invention, the handle may have a lid for forming a side wall of the handle. Thus, the access of user to the second profile or the connection profile from side may be prevented. It also may cover open side of the second profile or the connection profile particularly produced by extrusion.

In a possible embodiment of the invention, the lid may have at least one protrusion on an inner face thereof facing the connection profile and/or the second profile for fixing to the connection profile and/or the second profile. Thus, the fixation of the lid may be facilitated, since an additional fixing element is not needed. Having the protrusion on the inner face of the lid may make the handle have a smooth design and look due to not having any visual hole or fixing element.

In a possible embodiment of the invention, the lid may have two protrusions, the first protrusion is fixed to the connection profile and the second protrusion is fixed to the second profile. Thus, a stable connection may be achieved between the lid and the second profile and the connection profile. It may also secure the connection between the second profile and the connection profile. They may also be connected by the lid or may only be connected by the lid. The lid additionally may center the second profile and/or the connection profile, meaning that the lid may locate the second profile and/or the connection profile at the right point by the help of the protrusion.

In a possible embodiment of the invention, the protrusion may be fixed to the connection profile and/or the second profile by at least one of force-fit, form-fit or a fixing element. Thus, the connection may be facilitated by force-fit or form-fit connection. On the other hand, the connection may be strong and concrete by the help of a fixing element. The fixing element may be a screw. It may be used to fix one of the second profile and the connection profile to the protrusion. The fixation of fixing element may occur inside the handle, means behind the lid; so that the user cannot see the fixing element. The fixing element may be accessible after demounting the handle from the container.

Force-fit may be a clamp or a grabbing as fixing by the help of frictional force. Form-fit may be a snap-fit or slidable connection using the compatibility of forms of the corresponding sections of the connection profile and/or the second profile and the protrusion.

In a possible embodiment of the invention, the second profile and/or the connection profile may be at least one of metal, plastic and composite. Thus, especially having a metal second profile or the connection profile may make the handle durable enough to carry out its function on a fully loaded container for a long time.

The metal may be steel, aluminum, painted aluminum etc.

DETAILED DESCRIPTION OF THE INVENTION

Figure 1:
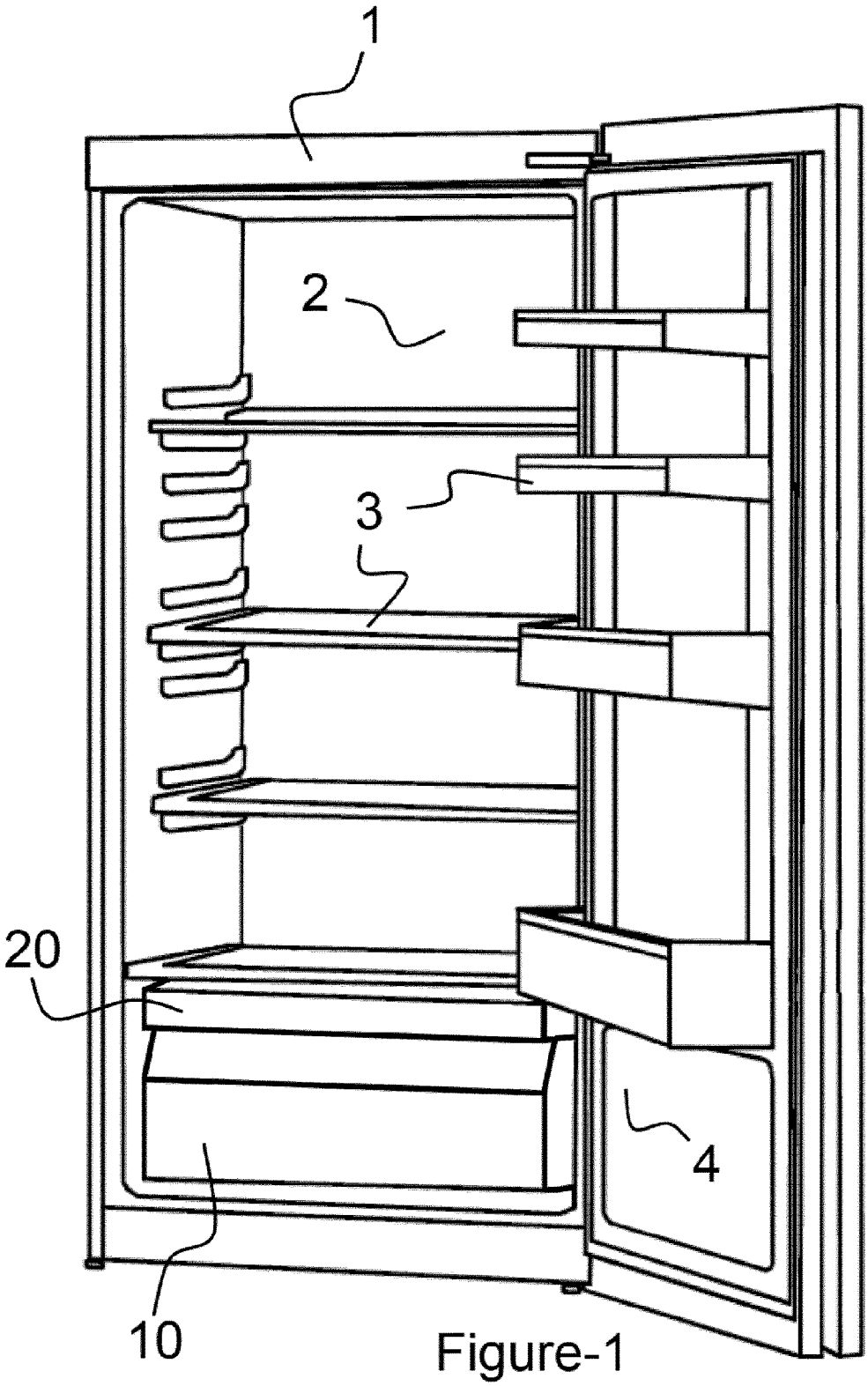
FIG. 1 represents the possible home appliance from front-right of the device, which is a domestic refrigerator, with a door being opened.

All directional references such as front, left or bottom are based on reference to the home appliance (1) shown in FIG. 1, in which the visible side is the "front" side of the home appliance (1) and the door (4) at the right is opened toward "right" side of the home appliance (1). One or more of possible embodiments of the present invention will be described as examples in detail below.

The invention is a home appliance (1). As presented in FIG. 1, it is for example a domestic refrigerator. The door (4) of the refrigerator is open and rotated toward right side in the figure. The door (4) is hinged to the refrigerator as rotatable around a hinge and covers the opening in front of the refrigerator as known in the art. Chamber (2) of the refrigerator, where an item (food etc.) is located, is defined by walls and the door (4). The refrigerator may have shelves (3) in the chamber (2), shelves (3) on the door (4) and/or a drawer-type container (10) to dispose an item therein.

The First Embodiment

Figure 2:
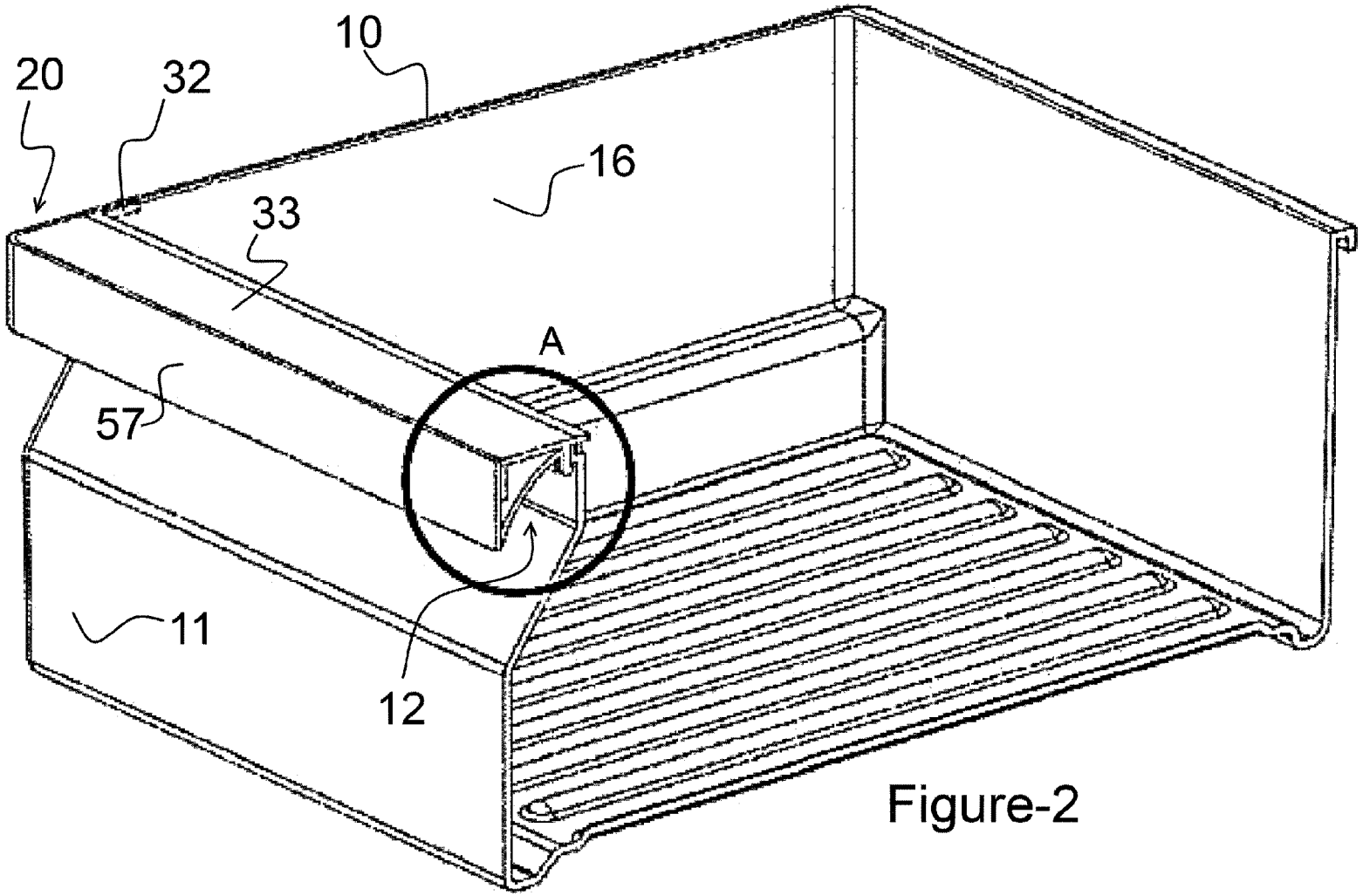
FIG. 2 represents the possible container from top-right of the container having the first possible embodiment of the handle and being cut in cross-sectional.

FIG. 2 shows the container (10) as cut in cross sectional. The container (10) has the first embodiment of the handle (20). The container (10) has a bottom and walls vertically rising around the bottom and an access opening on top. The handle (20) is on the front wall (11) of the container (10). The front wall (11) has a step-like form close to its upper edge, where the handle (20) is connected and which will be called from that point as the connection edge (13). This form of the front wall (11) provides together with the handle (20) a recess (12) for the user to put his hand and grip the handle (20). The handle (20) exists all along the width of the container (10).

Figure 3:
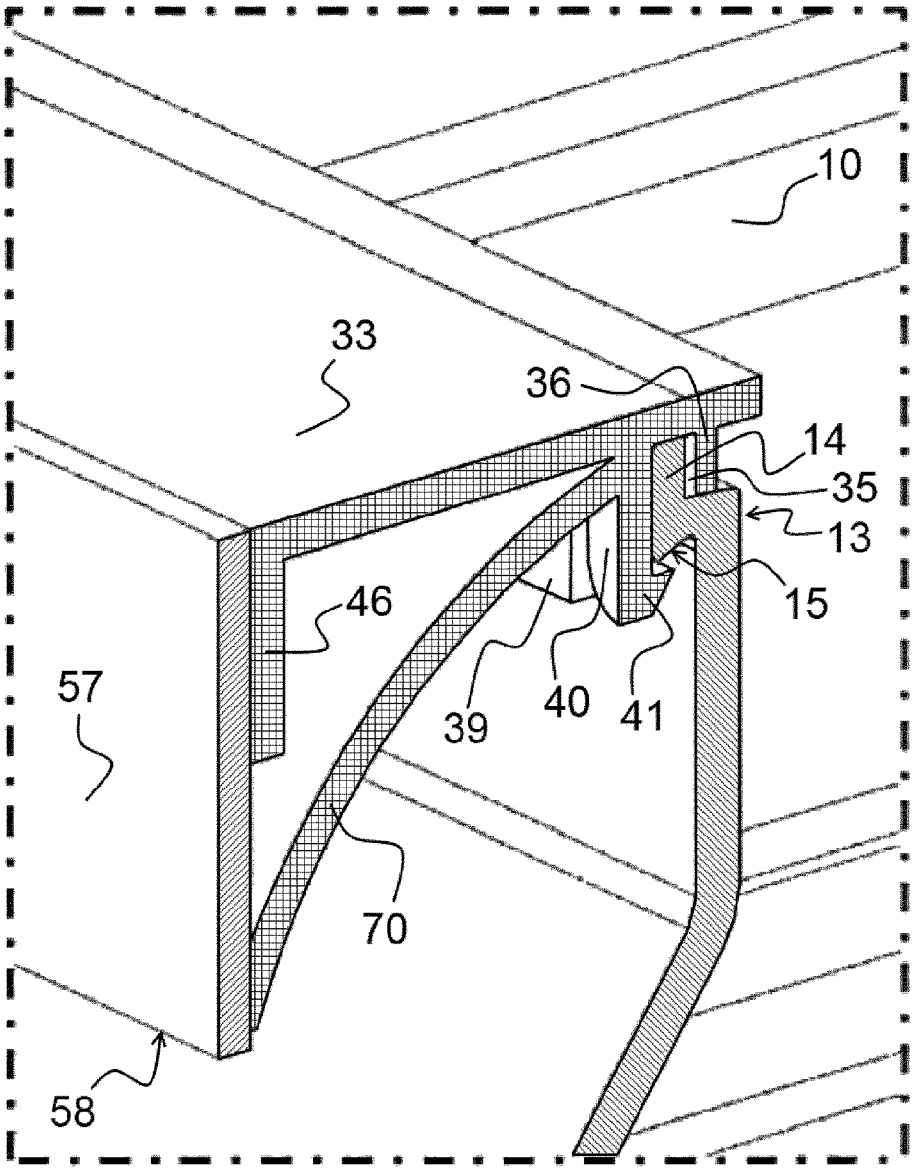
FIG. 3 represents the detail-A obtained from FIG. 2 showing the connection edge of the container, the connection profile and the second profile.

FIG. 3 presents the detail-A shown in FIG. 2 in a greater scale. The connection profile (30) is the profile connected to the connection edge (13) of the container (10). It is made of plastic or plastic based material for the first possible embodiment.

Figure 5:
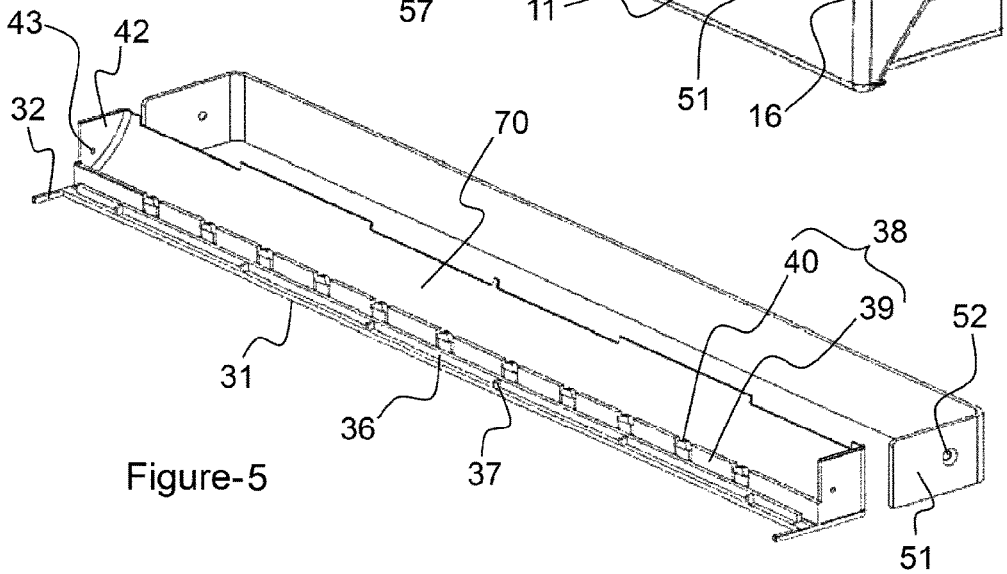
FIG. 5 represents the first embodiment of the handle from bottom-left as dismantled.

The connection profile (30) has a connection housing (35) close to a rear edge (31) of the connection profile (30) and exists along the rear edge (31). The connection housing (35) is delimited by an upper wall (33) of the connection profile (30), a rear housing wall (36) extending vertically downward from the upper wall (33), and a front housing wall (38) again extending vertically downward from the upper wall (33) and spaced from the rear housing wall (36). The front housing wall (38) extends downward more than the rear housing wall (36). The front housing wall (38) has horizontally spaced portions (39) and tabs (40) between each of two portions (39) as seen in FIG. 5. That means portions (39) and tabs (40) form the front housing wall (38). Moreover, by the help of such arrangement, the tabs (40) can spring and act flexibly.

The connection edge (13) of the container (10) has a cross section corresponds with the connection housing (35). Therefore, the connection edge (13) has a step toward front side and an offset wall (14) being at front side with an offset compared to a section of the front wall (11) close to the connection edge (13). After connection of the container (10) and the connection profile (30), in other words, after the connection edge (13) is positioned in the connection housing (35), the rear housing wall (36) remains in the container (10) and behind the offset wall (14). The front housing wall (38), as a result, the portions (39) and the tabs (40) remain in front of the offset wall (14). Finally, a hook end (41) of the tab (40) is positioned under the offset wall (14). The bottom face (15) of the offset wall (14) facing the hook end (41) of the tab (40) may be horizontal or, as in FIG. 3, may have a rising inclination from front to back. Thus the hook end (41) of the tab (40) can extend upward more and ensures that the connection is stronger and durable compared to an alternative having horizontal bottom face (15). Due to inclination, the handle (20) may be supported against vertically and horizontally applied forces by the bottom face (15). The handle (20) also supported by the offset wall (14) through the rear housing wall (36). The rear housing wall (36) has more than one horizontally spaced support walls (37) behind thereof for increasing its strength against applied forces (FIG. 5). The support wall (37) is formed as perpendicular to the rear housing wall (36). The connection wall (51) also has two rear protrusions (32) extending at both ends thereof and on the periphery of the opening of the container (10). Thus, recess details (5) of the container (10) on each side may be compensated; and a smooth surface and look may be achieved. The recess details (5) of the container (10) exist due to other embodiments of the connection profile (30) as providing brand or variant specific container (10) with a single design container (10).

The connection profile (30) has a gripping wall (70) for gripping and applying force to the handle (20) to pull the container (10). The gripping wall (70) has a cross section in form of a concave arc. It extends from front of the front housing wall (38) toward the second profile (50).

Figure 4:
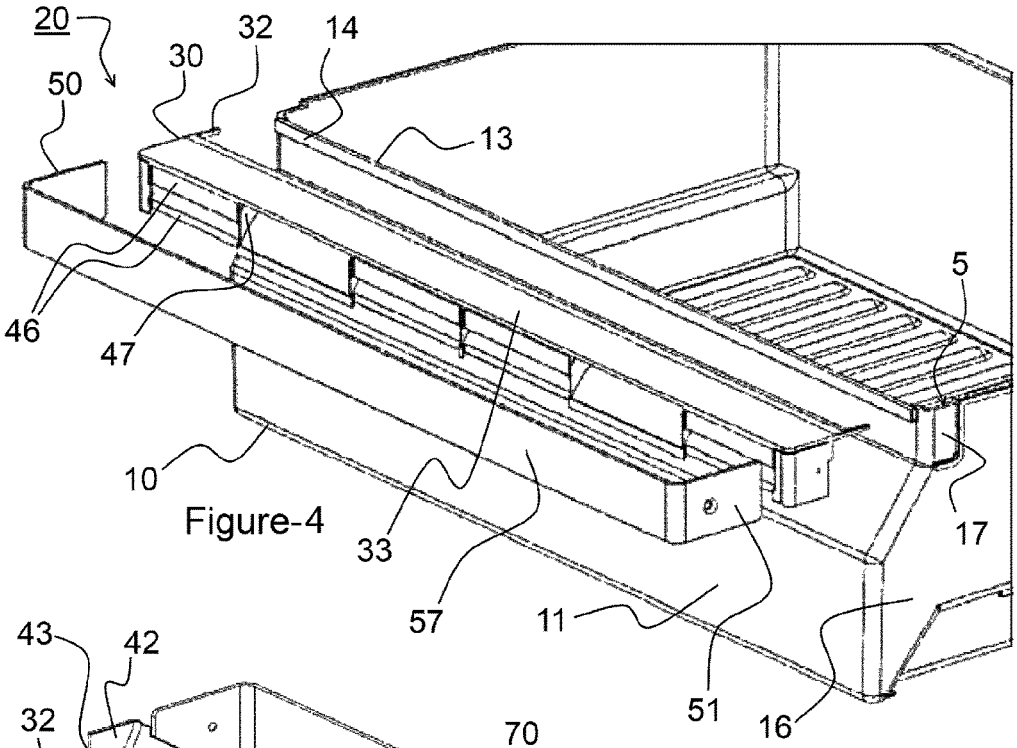
FIG. 4 represents the first embodiment of the handle and the container from top-right as dismantled.

FIG. 4 and FIG. 5 present the handle (20) as dismantled.

The connection profile (30) comprises more than one stiffening ribs (47) that are vertical plates located between the gripping wall (70) and the upper wall (33) of the connection profile (30). The stiffening ribs (47) support both gripping wall (70) and the upper wall (33) against deformation.

The connection profile (30) also has some adhesion walls (46) extending between the adjacent stiffening ribs (47) as facing forward. The adhesion walls (46) form a partial front wall for the connection profile (30). The adhesion walls (46) are used to adhere the second profile (50) to the connection profile (30).

The second profile (50) is made of a metal for the first embodiment of the handle (20). The second profile (50) is in a long-narrow plate form. It has two connection walls (51) at both ends like side walls. The connection profile (30) has also side walls (42) on right and left thereof. The connection walls (51) of the second profile (50) cover the side walls (42) of the connection profile (30). The connection walls (51) and the side walls (42) of the connection profile (30) have a hole (52, 43) for a screw (not shown in figures). During mounting the handle (20) on the container (10), the side walls (42) themselves, or together with the connection walls (51), are accommodated in side recesses (17) formed on the side walls (16) of the container (10) as neighbor to the connection edge (13) as shown in FIG. 4.

The Second Embodiment

Figure 6:
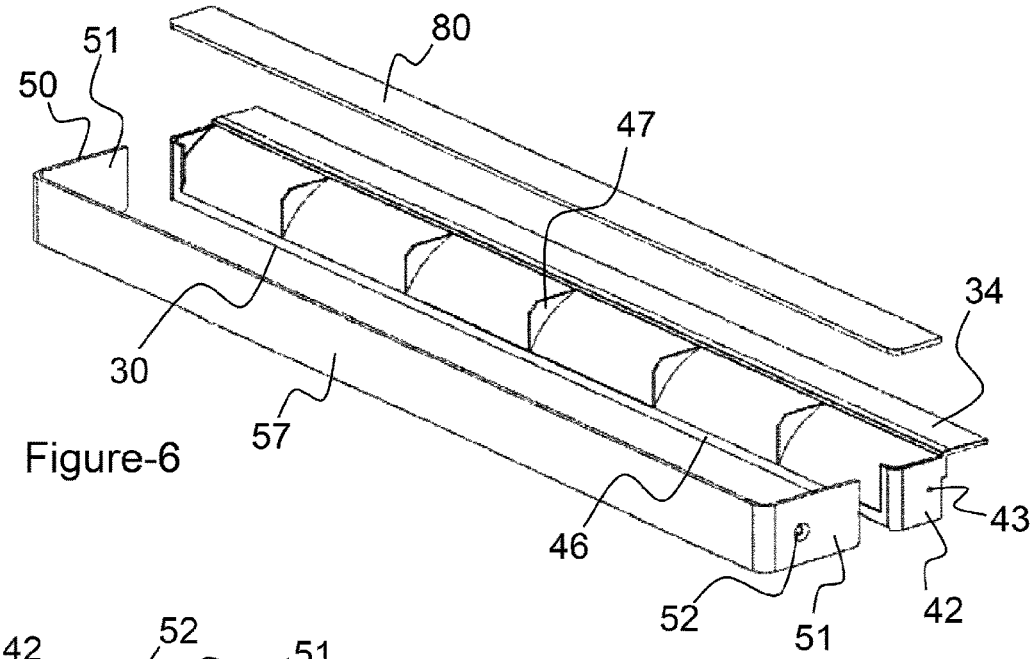
FIG. 6 represents the second embodiment of the handle from top-right as dismantled. It has the cover plate.
Figure 7:
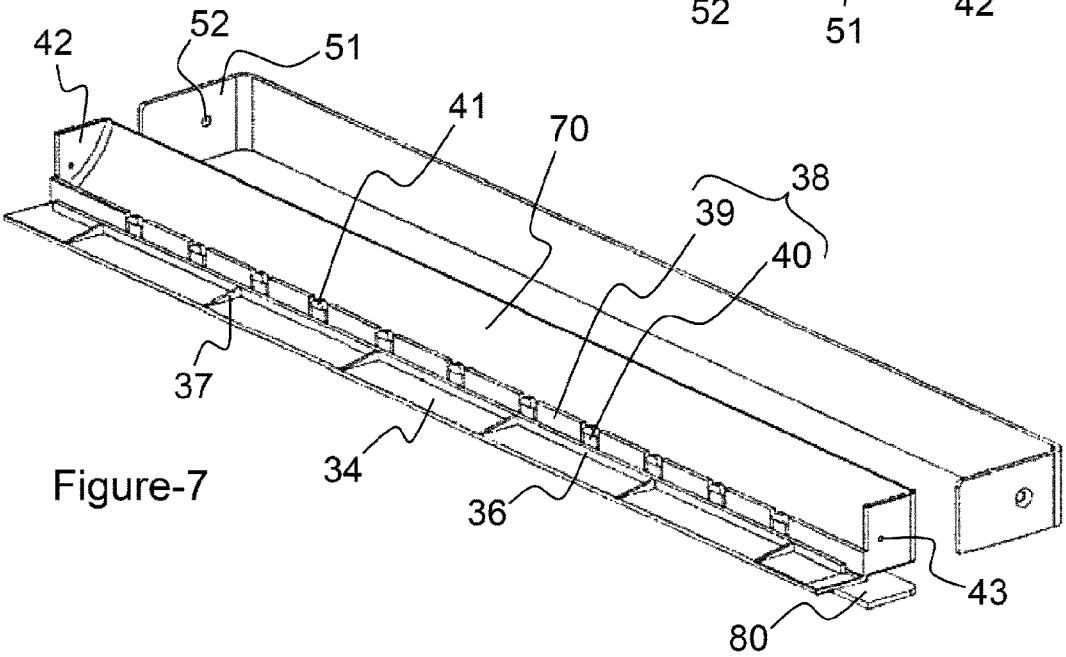
FIG. 7 represents the second embodiment of the handle from bottom-left as dismantled.

FIG. 6 and FIG. 7 represents the second embodiment of the handle (20). Most of the features mentioned above are also valid for the second embodiment. Compared to the first embodiment, the second embodiment has a cover plate (80). The cover plate (80) is made of metal for the second embodiment. It is used as the upper wall (33) of the connection profile (30). Therefore, the connection profile (30) of the second embodiment does not have the upper wall (33) as in the first embodiment.

The connection profile (30) of the second embodiment also does not have the adhesion walls (46) as same as ones of the first embodiment. In the second embodiment, the adhesion wall (46) extends as a frame on front side of the connection profile (30). However, it is a frame without an upper edge.

Lastly, in the second embodiment, the connection profile (30) has an extended upper wall (34) that extends over the opening of the container (10) compared to the rear protrusions (32) of the first embodiment. The support walls (37) of the rear housing wall (36) mentioned above extends until a rear edge of the extended upper wall (34). The support walls (37) seem like a triangle from right or left. Thus, desired strength is obtained with less material usage.

The Third Embodiment

Figure 8:
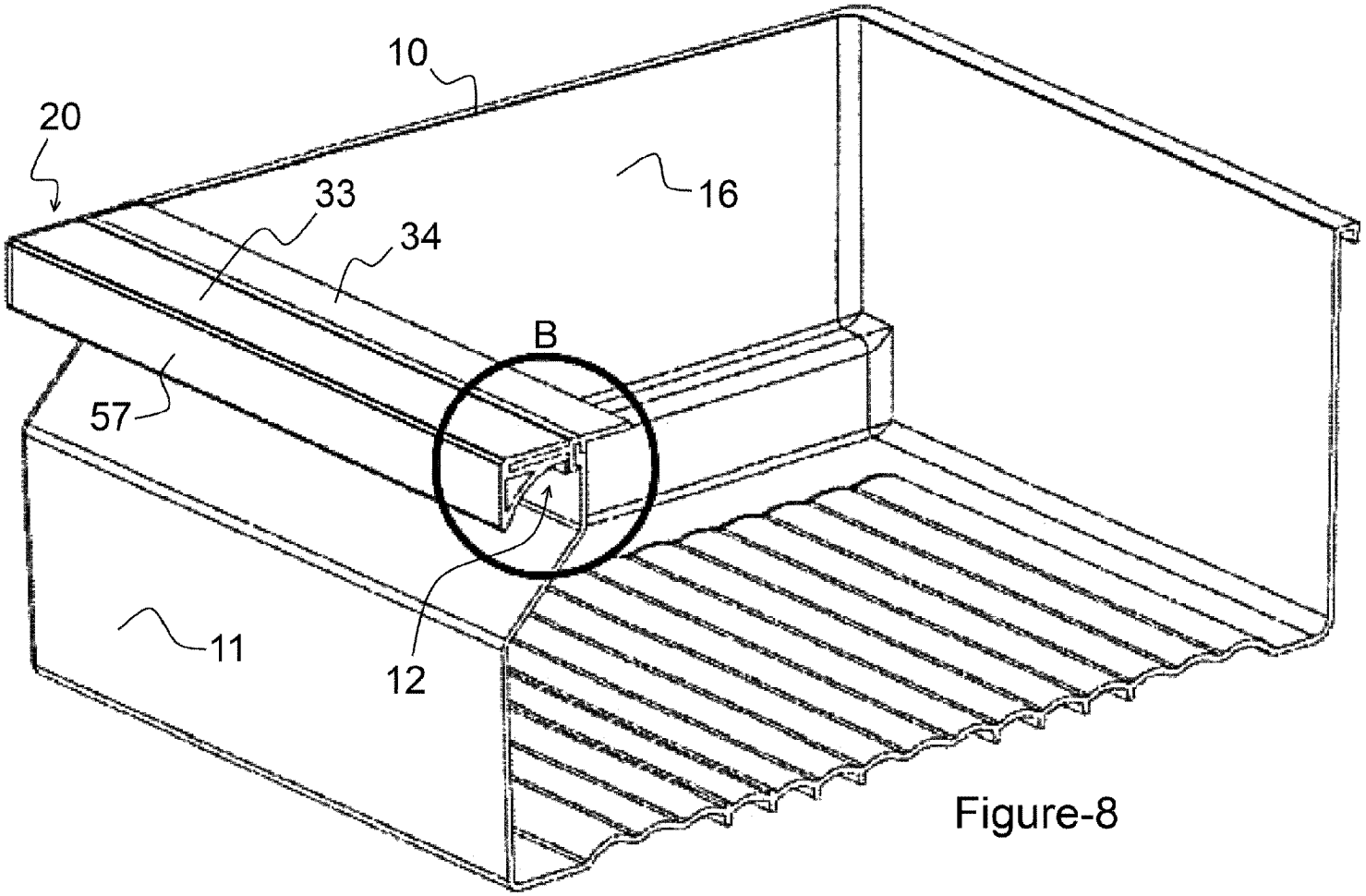
FIG. 8 represents the possible container from top-right of the container having the third possible embodiment of the handle and being cut in cross-sectional.

FIG. 8 shows a container (10) with the handle (20) of the third embodiment.

Figure 9:
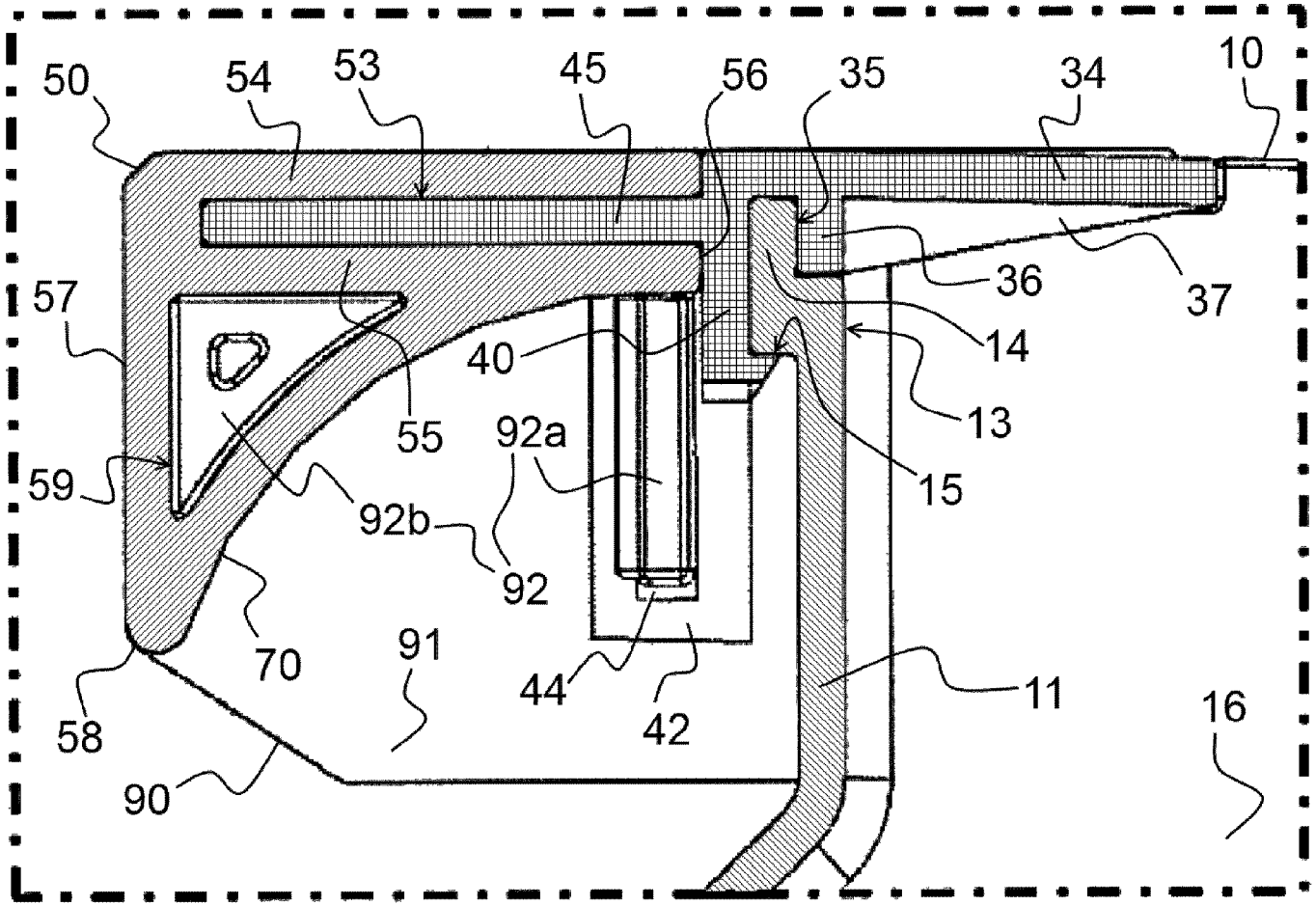
FIG. 9 represents right view of the detail-B obtained from FIG. 8 showing the connection edge of the container, the connection profile and the second profile.

As presented in FIG. 9, the connection profile (30) and the second profile (50) differ from the ones of the first and second embodiments.

The connection housing (35) and the extended upper wall (34) of the connection profile (30) are same as the second embodiment. However, the third embodiment does not have the gripping wall (70), the upper wall (33) and the stiffening ribs (47). The connection profile (30) has an extension (45) as a horizontal plate extending from behind the front housing wall (38).

The second profile (50) has a horizontal housing (53) for the extension (45). The housing (53) of the second profile (50) is delimited by an upper wall (54), a lower wall (55) and a front wall (57) of the second profile (50). The distance between the upper wall (54) and the lower wall (55) is same or less than the thickness of the plate-form extension (45). In FIG. 9, it is the same. Therefore, the extension (45) and connectively the connection profile (30) is connected to the second profile (50) by force-fit connection. The depth of the housing (53) is same or longer than the depth of the extension (45). In FIG. 9, it is the same.

The connection profile (30) is made of plastic or plastic based material like previous embodiments. The second profile (50) is made of metal as previous embodiments.

The second profile (50) is obtained by metal extrusion. It has the gripping wall (70). The gripping wall (70) has a cross section in form of a concave arc. It extends between a rear edge (56) of the lower wall (55) and a lower edge (58) of the front wall (57) of the second profile (50).

Figure 10:
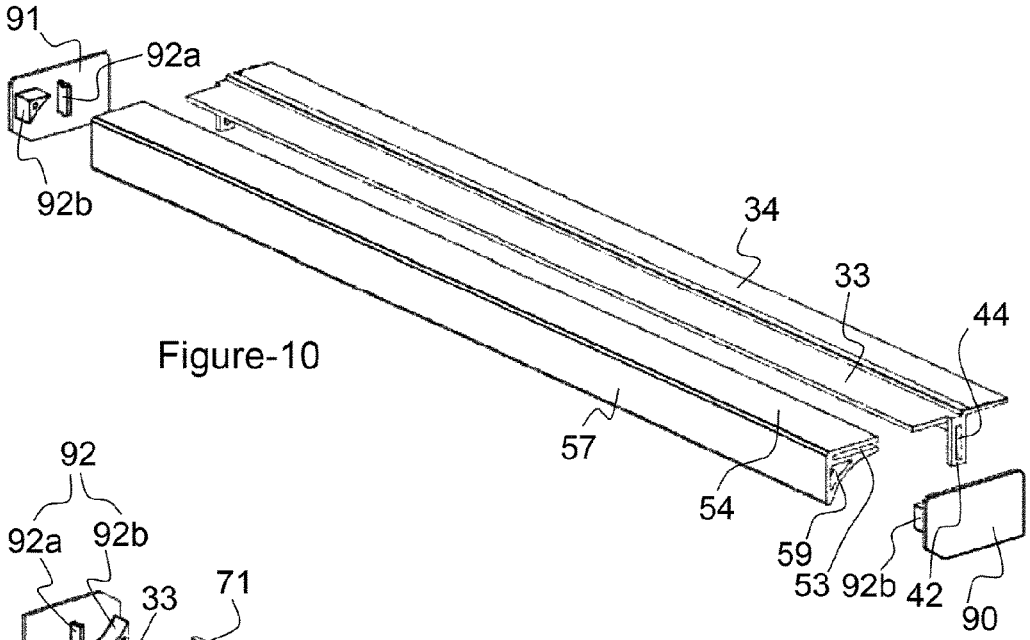
FIG. 10 represents the third embodiment of the handle from top-right as dismantled. It has the lid.
Figure 11:
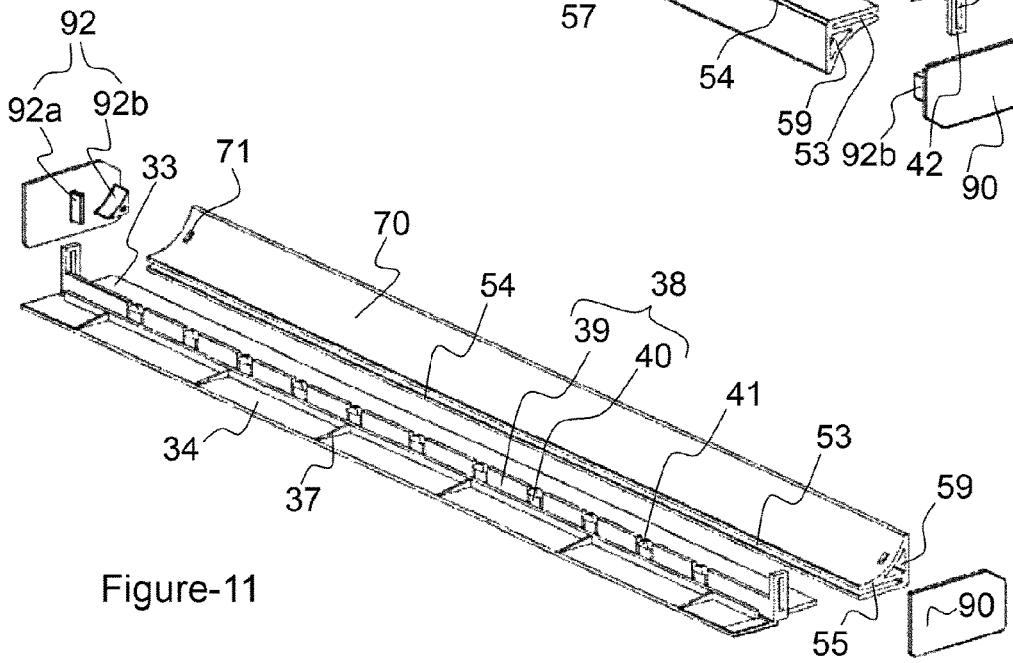
FIG. 11 represents the third embodiment of the handle from bottom-left as dismantled.

As shown in the FIG. 10 and FIG. 11, the connection profile (30) has the side wall (42) narrower than the previous embodiments and having a cut-out (44). In addition to that, the second profile (50) is obtained as hollow and having a space (59) between the lower wall (55), the gripping wall (70) and the front wall (57).

The third embodiment has a lid (90) as in FIG. 9,10,11. The lid (90) has two protrusions (92) on an inner face (91) thereof. The first protrusion (92*a*) penetrates the cut-out (44). The second protrusion (92*b*) penetrates into the space (59).

The first protrusion (92*a*) is in form of a tab and has a hook end. The second protrusion (92*b*) has the same cross section as the space (59) dimensionally same or smaller.

The gripping wall (70) has a fixing opening (71) correspond to the second protrusion (92*b*) inside the space (59). Through the fixing opening (71), a fixing element (not shown in figures) like a screw is penetrated and fixed to the second protrusion (92*b*) inside the space (59). Thus a durable fixing is achieved. After mounting the connection profile (30), the second profile (50) and the lid (90); at least some part of the lid (90) is accommodated in the side recess (17) of the container.

The support walls (37) for the rear housing wall (36) exist on the third embodiment as in the second embodiment.

| Reference Numbers | |
|---|---|
| 1. | Home appliance |
| 2. | Chamber |
| 3. | Shelf |
| 4. | Door |
| 5. | Recess detail |
| 10. | Container |
| 11. | Front wall |
| 12. | Recess |
| 13. | Connection edge |
| 14. | Offset wall |

-continued

| Reference Numbers | |
|---|---|
| 15. | Bottom face |
| 16. | Side wall |
| 17. | Side recess |
| 20. | Handle |
| 30. | Connection profile |
| 31. | Rear edge |
| 32. | Rear protrusion |
| 33. | Upper wall |
| 34. | Extended upper wall |
| 35. | Connection housing |
| 36. | Rear housing wall |
| 37. | Support wall |
| 38. | Front housing wall |
| 39. | Portion |
| 40. | Tab |
| 41. | Hook end |
| 42. | Side wall |
| 43. | Hole |
| 44. | Cut-out |
| 45. | Extension |
| 46. | Adhesion wall |
| 47. | Stiffening rib |
| 50. | Second profile |
| 51. | Connection wall |
| 52. | Hole |
| 53. | Housing |
| 54. | Upper wall |
| 55. | Lower wall |
| 56. | Rear edge |
| 57. | Front wall |
| 58. | Lower edge |
| 59. | Space |
| 70. | Gripping wall |
| 71. | Fixing opening |
| 80. | Cover plate |
| 90. | Lid |
| 91. | Inner face |
| 92. | Protrusion |
| 92a | First protrusion |
| 92b | Second protrusion |

The invention claimed is:

1. A home appliance, comprising:

a container being a drawer-shaped movable container; and a handle for said container, said handle having a first profile being a connection profile affixed to said container and a second profile affixed to said connection profile, for forming said handle;

said handle including a lid forming a side wall of said handle, said lid having an inner face and first and second protrusions formed on said inner face, said first protrusion facing and being fixed to said connection profile and said second protrusion facing and being fixed to said second profile.

2. The home appliance according to claim 1, wherein said connection profile is connected to said container by at least one of a force-fitting connection and a form-fitting connection.

3. The home appliance according to claim 2, wherein said container is formed with a connection edge and said connection profile has a connection housing for receiving said connection edge of said container.

4. The home appliance according to claim 2, wherein said connection profile includes a tab for connecting to said container.

5. The home appliance according to claim 1, wherein said connection profile and said second profile are connected to one another by at least one connection selected from the group consisting of a force-fitting connection, a form-fitting connection, an adhesive connection and a fixing-element connection.

6. The home appliance according to claim 5, wherein one of said second profile and said connection profile is formed with a housing for receiving an extension and the other of said second profile and said connection profile is formed with said extension.

7. The home appliance according to claim 6, wherein said extension is a plate.

8. The home appliance according to claim 5, wherein said connection profile has an adhesion wall for said second profile.

9. The home appliance according to claim 1, wherein said second profile is formed with a connection wall covering a side wall of said connection profile.

10. The home appliance according to claim 9, wherein said connection wall of said second profile is formed with a hole for a fixing element.

11. The home appliance according to claim 1, wherein at least one of said second profile and said connection profile is formed with a gripping wall.

12. The home appliance according to claim 11, wherein said second profile or said connection profile includes a stiffening rib for supporting said gripping wall.

13. The home appliance according to claim 1, wherein said handle includes a cover plate forming an upper wall of said handle.

14. The home appliance according to claim 13, wherein said cover plate is formed of a material selected from the group consisting of metal, plastic and composite.

15. The home appliance according to claim 1, wherein said first protrusion is fixed to said connection profile and/or to and said second protrusion is fixed to said second profile by at least one connection selected from the group consisting of a force-fit, a form-fit and a fixing element.

16. The home appliance according to claim 1, wherein one or both of said second profile or said connection profile is formed of a material selected from the group consisting of a metal, a plastic and a composite.

17. The home appliance according to claim 1, formed as a domestic refrigerator have a refrigerator housing accommodating said container in the form of a drawer.

* * * * *